US009977374B2

(12) United States Patent
Takashima et al.

(10) Patent No.: US 9,977,374 B2
(45) Date of Patent: May 22, 2018

(54) TRANSFER UNIT AND IMAGE FORMING APPARATUS INCLUDING A BELT-SHAPED TRANSFER TARGET MEMBER

(71) Applicant: FUJI XEROX CO., LTD., Tokyo (JP)

(72) Inventors: Yoshiyuki Takashima, Kanagawa (JP); Masakazu Shirai, Kanagawa (JP); Hiroaki Yagi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 15/446,146

(22) Filed: Mar. 1, 2017

(65) Prior Publication Data

US 2018/0004130 A1 Jan. 4, 2018

(30) Foreign Application Priority Data

Jul. 4, 2016 (JP) ..... 2016-132306

(51) Int. Cl.
*G03G 15/16* (2006.01)

(52) U.S. Cl.
CPC ..... *G03G 15/1605* (2013.01)

(58) Field of Classification Search
CPC ..... G03G 15/1605; G03G 15/161; G03G 15/165; G03G 15/1665
USPC ..... 399/121, 302
See application file for complete search history.

(56) References Cited

U.S. PATENT DOCUMENTS 9,448,528 B2 * 9/2016 Yamaguchi ..... G03G 15/1665
9,535,374 B1 * 1/2017 Embry et al. ..... G03G 15/161
2005/0169667 A1 8/2005 Katoh

FOREIGN PATENT DOCUMENTS

JP 2005-189664 A 7/2005

* cited by examiner

*Primary Examiner* — William J Royer
(74) *Attorney, Agent, or Firm* — Sughrue Mion, PLLC

(57) ABSTRACT

A transfer unit includes a transfer target member, a first transfer device, and a holding member. The transfer target member has an image region to which an image is transferred and a non-image region to which the image is not transferred and which exists along an edge of the transfer target member. The transfer target member is transported in a path passing through a contact position where the transfer target member is brought into contact with an image holding body, which has a surface on which the image is held, so as to allow the image to be transferred to the transfer target member. The first transfer device transfers the image from the image holding body to the transfer target member. The holding member is brought into contact with the non-image region so as to hold the transfer target member without contact with the image region.

13 Claims, 13 Drawing Sheets

TRANSFER UNIT AND IMAGE FORMING APPARATUS INCLUDING A BELT-SHAPED TRANSFER TARGET MEMBER

CROSS-REFERENCE TO RELATED APPLICATIONS

This application is based on and claims priority under 35 USC 119 from Japanese Patent Application No. 2016-132306 filed Jul. 4, 2016.

BACKGROUND

(i) Technical Field

The present invention relates to a transfer unit and an image forming apparatus.

(ii) Related Art

There are known related-art image forming apparatuses using, for example, an electrophotographic system with which an image is transferred from an image holding body to a transfer belt serving as a belt-shaped transfer target member and further transferred from the transfer belt to a sheet serving as a recording medium. In many of such image forming apparatuses, a transfer unit that includes the transfer belt is detachably attachable due to a demand for maintainability.

SUMMARY

According to an aspect of the present invention, a transfer unit includes a transfer target member, a first transfer device, and a holding member. The belt-shaped transfer target member has an edge, an image region to which the image is transferred, and a non-image region to which the image is not transferred and which exists along the edge of the transfer target member. The transfer target member is transported in a path passing through a contact position at which the transfer target member is brought into contact with an image holding body, which has a surface on which the image is held, so as to allow the image to be transferred to the transfer target member. The first transfer device transfers the image from the image holding body to the transfer target member. The holding member is brought into contact with the non-image region from an image holding body side so as to hold the transfer target member while contact of the holding member with the image region is avoided.

BRIEF DESCRIPTION OF THE DRAWINGS

Exemplary embodiment of the present invention will be described in detail based on the following figures, wherein.

DETAILED DESCRIPTION

An exemplary embodiment of the present invention will be described below with reference to the drawings.

Figure 1:
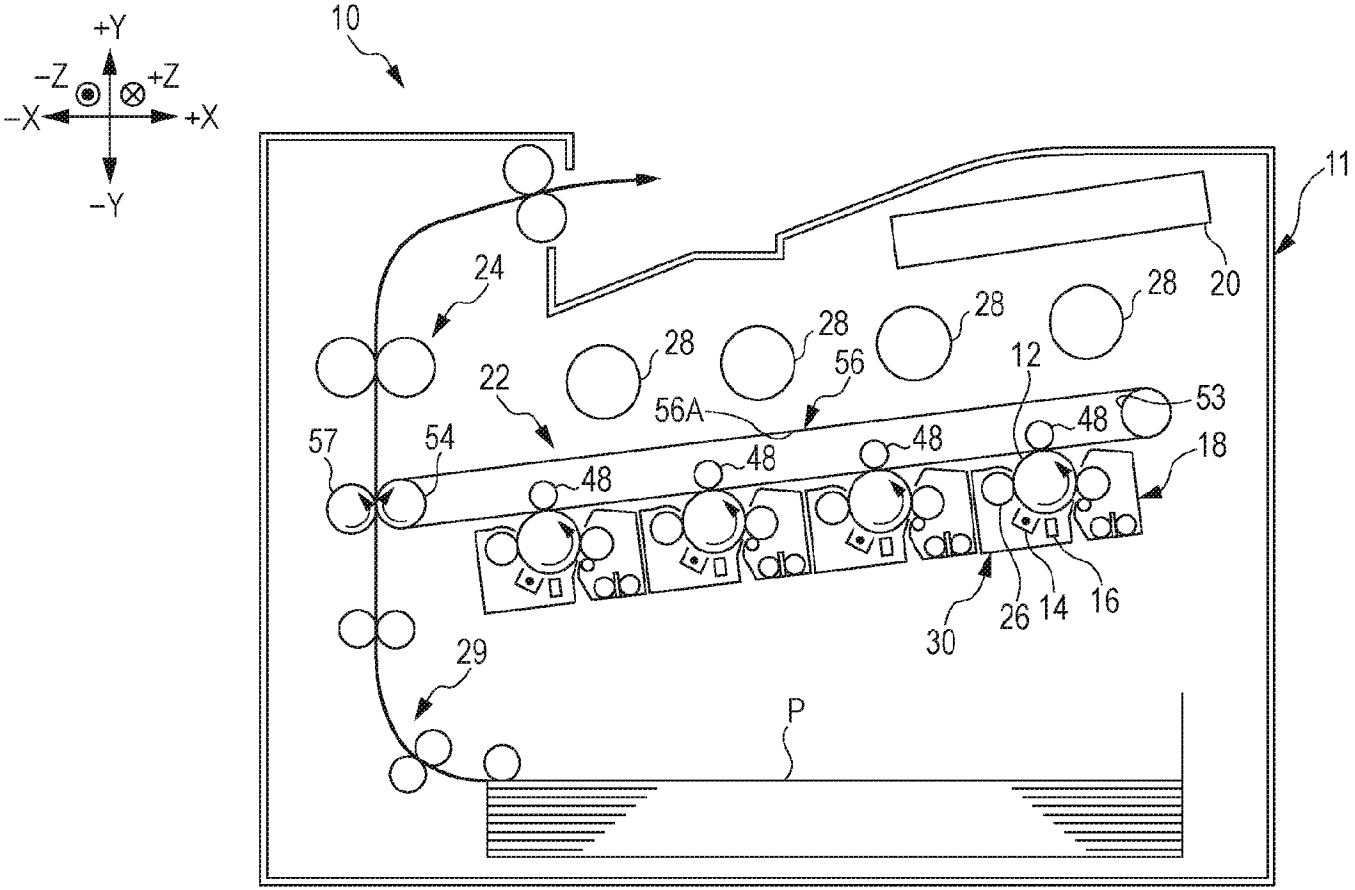
FIG. 1 is a schematic structural view of a printer corresponding to one specific exemplary embodiment of an image forming apparatus.

FIG. 1 is a schematic structural view of a printer corresponding to one specific exemplary embodiment of an image forming apparatus.

A printer 10 of FIG. 1 includes the following components disposed in a housing 11: photosensitive units 30, developing devices 18, a transfer unit 22, a fixing device 24, a sheet transport device 29, a second transfer roller 57, toner cartridges 28, and a controller 20. Each of the photosensitive units 30, a corresponding one of the developing devices 18, and a corresponding one of the toner cartridges 28 are provided as a set. In total, four of the set are provided, and each set is provided for a corresponding one of C, M, Y, and K colors.

A photoconductor 12, a charger 14, a light exposure device 16, and a cleaner 26 are incorporated in each of the photosensitive units 30. The photosensitive units 30 are detachably attached to the housing 11. Also, the developing devices 18 and the transfer unit 22 are detachably attached to the housing 11. This transfer unit 22 corresponds to one exemplary embodiment of the transfer unit.

In the following description, regarding the directions of the printer 10, the width direction of the apparatus which is the left-right direction in FIG. 1 is referred to as the X direction, the height direction of the apparatus which is the up-down direction in FIG. 1 is referred to as the Y direction, and the depth direction of the apparatus which is perpendicular to the page of FIG. 1 is referred to as the Z direction. According to the present exemplary embodiment, the X direction and the Z direction are the horizontal directions and the Y direction is the vertical direction. It is assumed that the printer 10 is operated by a user who stands in front of the printer 10 in the Z direction. The photosensitive units 30, the developing devices 18, and the transfer unit 22 are attached and detached by being inserted or removed in the Z direction.

The transfer unit 22 includes a support roller 53 and a backup roller 54 and also includes an annular transfer belt 56 stretched around the support roller 53 and the backup roller 54. The transfer unit 22 further includes a tension roller 52. The transfer belt 56 is also stretched around the tension roller 52 (see FIG. 4). Illustration of the tension roller 52 is omitted from FIG. 1. The transfer belt 56 is rotated along a circular path in contact with the photoconductors 12 of the photosensitive units 30. Furthermore, the transfer unit 22 includes first transfer rollers 48 at positions facing the respective photoconductors 12 with the transfer belt 56 interposed therebetween.

Here, operation of the printer 10 is described.

Upon obtaining image data from an external device such as a personal computer, the controller 20 causes a printing operation to start. Accordingly, the surfaces of the photoconductors 12 are entirely charged by the chargers 14. The charged surfaces are exposed to light in accordance with the image data with the light exposure devices 16, thereby electrostatic latent images are formed.

The electrostatic latent images are developed with developer contained in the developing devices 18. The developer contains toner. Thus, visible toner images are formed on the photoconductors 12 through the development.

The toner images on the photoconductors 12 are transferred onto the transfer belt 56 by the first transfer rollers 48 of the transfer unit 22 such that the toner images of the four colors are sequentially superposed one on top of another. As a result, a color toner image is formed on the transfer belt 56. The photoconductors 12 each correspond to an example of an image holding body, the transfer belt 56 corresponds to an example of a transfer target member, and the first transfer rollers 48 each correspond to an example of a first transfer device.

The surfaces of the photoconductors 12 from which the toner images have been transferred are cleaned by the cleaners 26, thereby undesired substances such as residual toner and paper dust are removed.

The color toner image on the transfer belt 56 is transferred onto a sheet P serving as a recording medium transported to a nip between the backup roller 54 and the second transfer roller 57 by the sheet transport device 29. Then, the sheet P is transported to the fixing device 24, the color toner image is fixed onto the sheet P, and the sheet P is fed to the outside of the housing 11.

Figure 2:
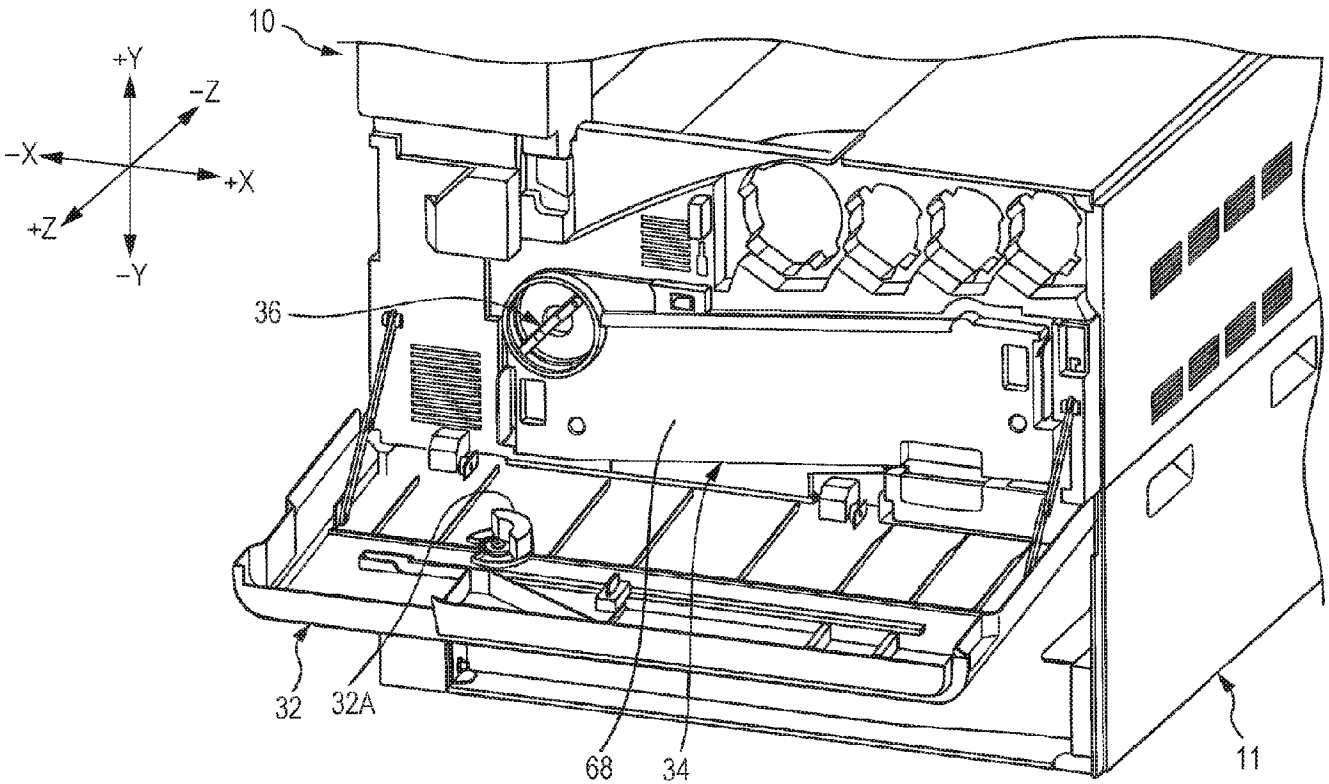
FIG. 2 illustrates a state in which a housing is opened during attachment or detachment of components.

FIG. 2 illustrates a state in which the housing 11 is opened during attachment or detachment of the components.

A covering 32 rotatable toward the front side in the Z direction is attached on a front surface of the housing 11 of the printer 10 in the Z direction. A collection box 34 is detachably attached to the housing 11 on the rear side of the covering 32 in the Z direction. The above-described undesired substances are collected in the collection box 34 from the cleaners 26 of the photosensitive units 30.

The collection box 34 includes a body portion 68 in which the undesired substances are collected and stored.

An operating handle 36 is provided in a surface of the collection box 34 on the front side in the Z direction. The collection box 34 is unlocked from the housing 11 when the operating handle 36 is rotated, for example, counterclockwise, and the collection box 34 is locked to the housing 11 when the operating handle 36 is rotated, for example, clockwise.

A stopper 32A is provided in the covering 32 so as to project to the inside of the printer 10. When the covering 32 is closed, this stopper 32A is engaged with the operating handle 36 portion of the collection box 34 so as to prevent rotation of the operating handle 36. As a result, a situation in which, for example, the operating handle 36 is unintentionally rotated due to vibration of the apparatus or the like may be avoided. Conversely, when the orientation of the operating handle 36 is different from an orientation assumed when the collection box 34 is locked to the housing 11, the stopper 32A interferes with the operating handle 36 so as to prevent closing of the covering 32. This may prevent operation of the operating handle 36 from being forgotten.

When the collection box 34 is detached from the printer 10, the components such as the transfer unit 22 disposed further to the rear side than the collection box 34 are exposed.

Figure 3:
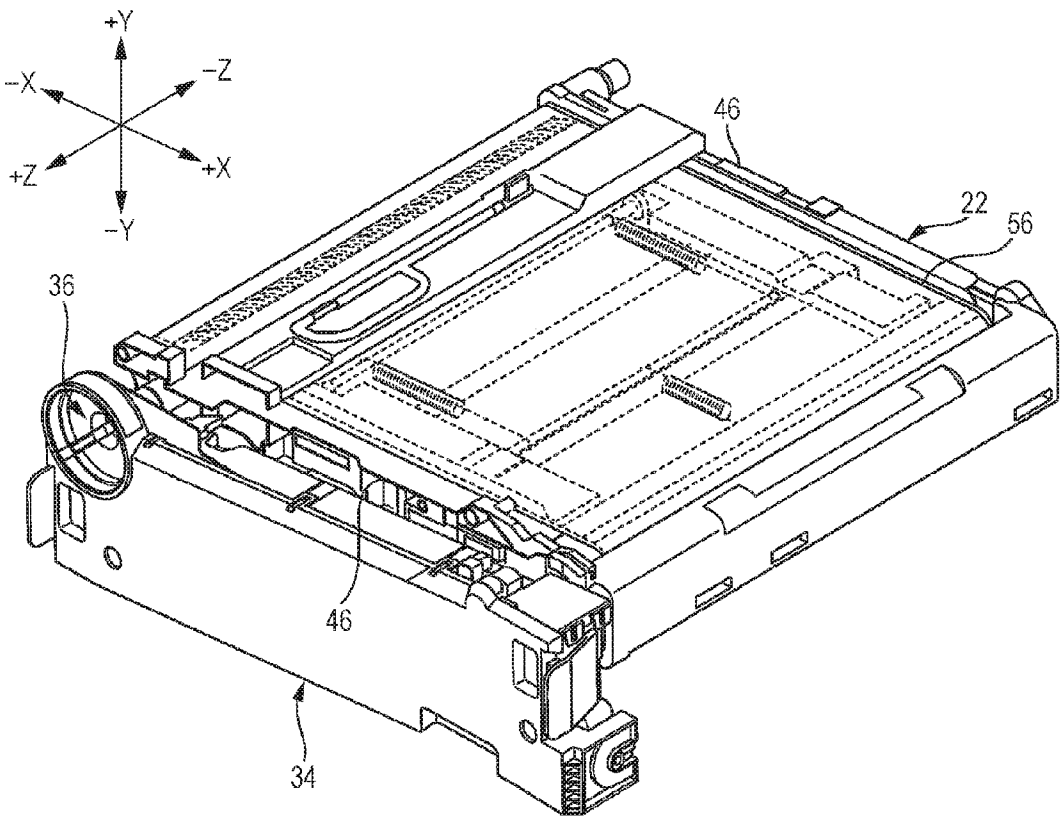
FIG. 3 illustrates an arrangement relationship between a collection box and a transfer unit.

FIG. 3 illustrates an arrangement relationship between the collection box 34 and the transfer unit 22.

The transfer unit 22 is disposed further to the rear side in the Z direction than the collection box 34, and the width direction of the transfer belt 56 extends in the Z direction. Furthermore, the transfer unit 22 includes a pair of side frames 46 which are members having elongated shapes. The longitudinal direction of the pair of side frames 46 extends in the apparatus width direction (X direction). The side frames 46 are spaced from each other in the apparatus depth direction (Z direction) with the transfer belt 56 interposed therebetween.

Figure 4:
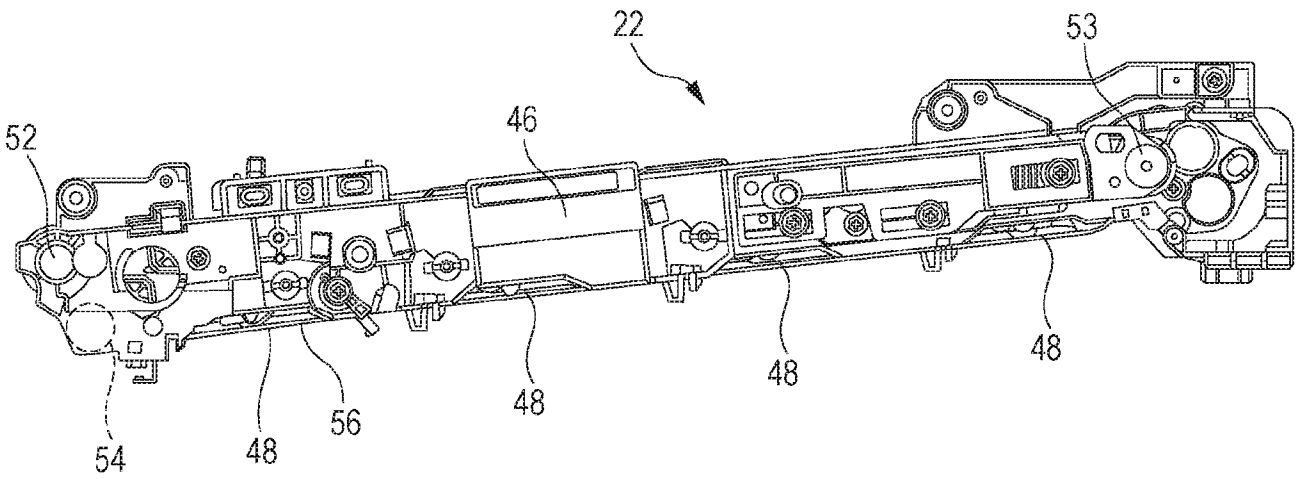
FIG. 4 is an external side view of a side surface of the transfer unit that faces the collection box.

FIG. 4 is an external side view of a side surface of the transfer unit 22 that faces the collection box 34.

The tension roller 52 is disposed on one end portion side of the side frames 46 in the longitudinal direction (a left end portion side in the apparatus width direction). The support roller 53 is disposed on the other end portion side of the side frames 46 in the longitudinal direction (a right end portion side in the apparatus width direction). The backup roller 54 is disposed on the one end portion side of the side frames 46 which is the same side as the end portion side where the tension roller 52 is disposed in the longitudinal direction (the left end portion side in the apparatus width direction).

The tension roller 52, the support roller 53, and the backup roller 54 are rotatably held by the side frames 46. The transfer belt 56 stretched around the tension roller 52, the support roller 53, and the backup roller 54 is flatly spread due to a tensile force applied to the transfer belt 56 by the tension roller 52.

The first transfer rollers 48 are disposed on an inner circumferential side of the transfer belt 56. Four of the first transfer rollers 48 are disposed on the inner circumferential side of the transfer belt 56. In order to prevent the first transfer rollers 48 and the transfer belt 56 from being brought into contact with other components (for example, the photosensitive units 30 and the developing devices 18) during the attachment and detachment of the transfer unit 22, as will be described later, a separation mechanism that moves the first transfer rollers 48 and the transfer belt 56 in a direction separating from the photoconductors 12 of the photosensitive units 30 is also incorporated in the transfer unit 22.

The transfer belt 56 stretched around the tension roller 52, support roller 53, and the backup roller 54 may gradually deviate (walk) in directions intersecting the rotating direction when the transfer belt 56 is rotated on the tension roller 52, the support roller 53, and the backup roller 54. In order to prevent this walking of the transfer belt 56, a rib that extends along an edge of the transfer belt 56 and projects toward the inner circumferential side of the transfer belt 56 is provided according to the present exemplary embodiment.

Figure 5:
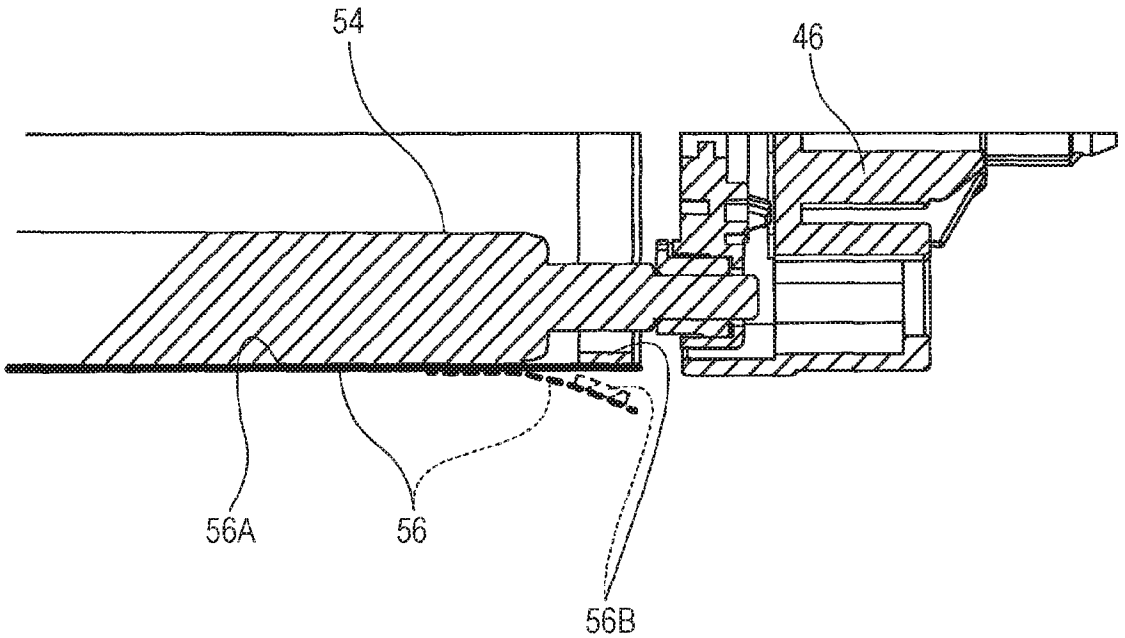
FIG. 5 illustrates a rib of a transfer belt.

FIG. 5 illustrates a rib of the transfer belt 56.

In FIG. 5, a section taken along a rotational center of the backup roller 54 is illustrated, and the transfer belt 56 is located inside one of the side frames 46. A rib 56B is provided along the edge of the transfer belt 56. The rib 56B prevents the above-described walking. However, because of the presence of the rib 56B, the backup roller 54 is in contact with only a central portion of the inner surface 56A of the transfer belt 56 excluding an edge portion. Likewise, the tension roller 52 and the support roller 53 described above are also in contact with only the central portion of the transfer belt 56. Accordingly, a tensile force applied to the transfer belt 56 is reduced at the edge portion. As a result, the edge of the transfer belt 56 is likely to be loosened as illustrated in dotted lines of FIG. 5. When the edge of the transfer belt 56 is loosened as described above, the transfer belt 56 may be brought into contact with the other components during the attachment and detachment of the transfer unit 22. Accordingly, a holding mechanism that holds the edge of the transfer belt 56 so as to suppress the loosening is provided according to the present exemplary embodiment.

Figure 6:
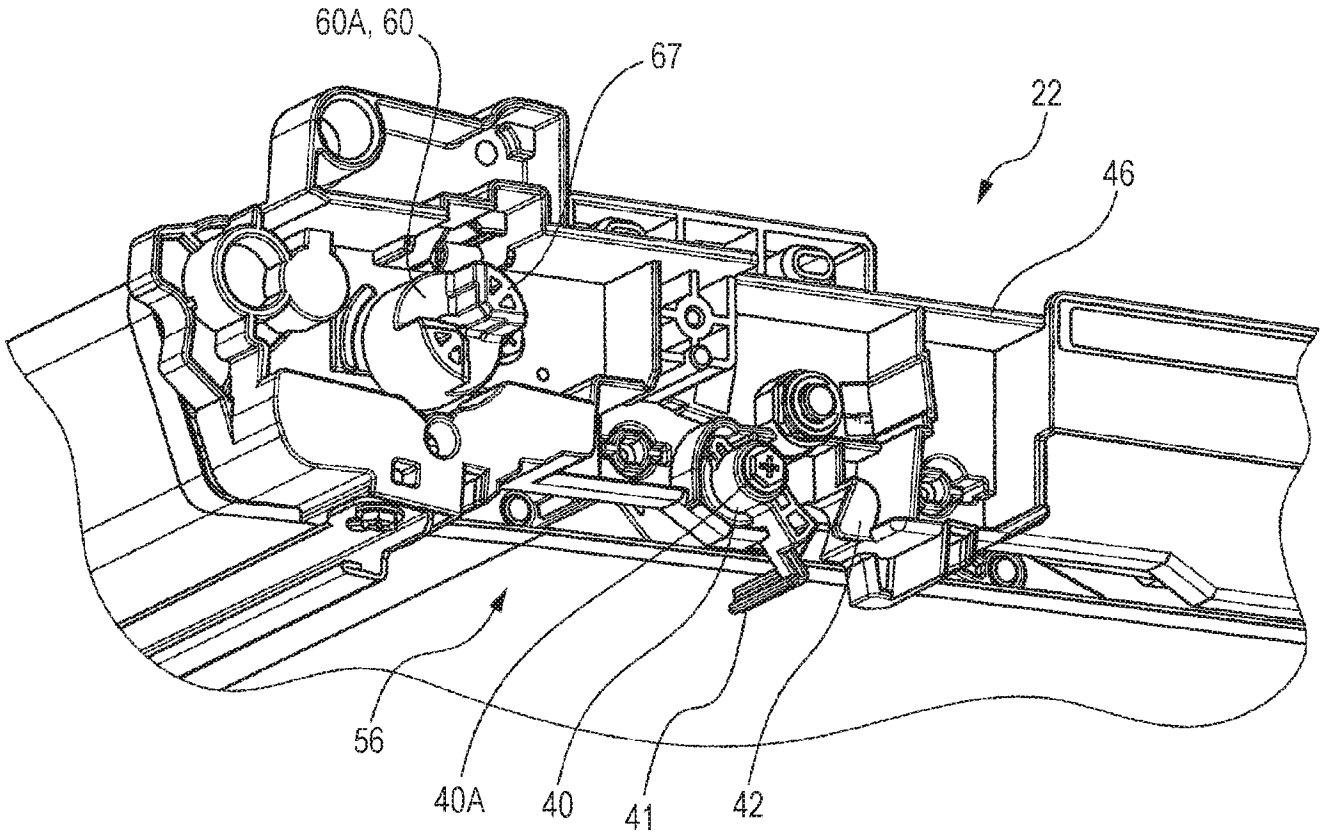
FIG. 6 illustrates the appearance of a holding mechanism before the edge of the transfer belt is held.
Figure 7:
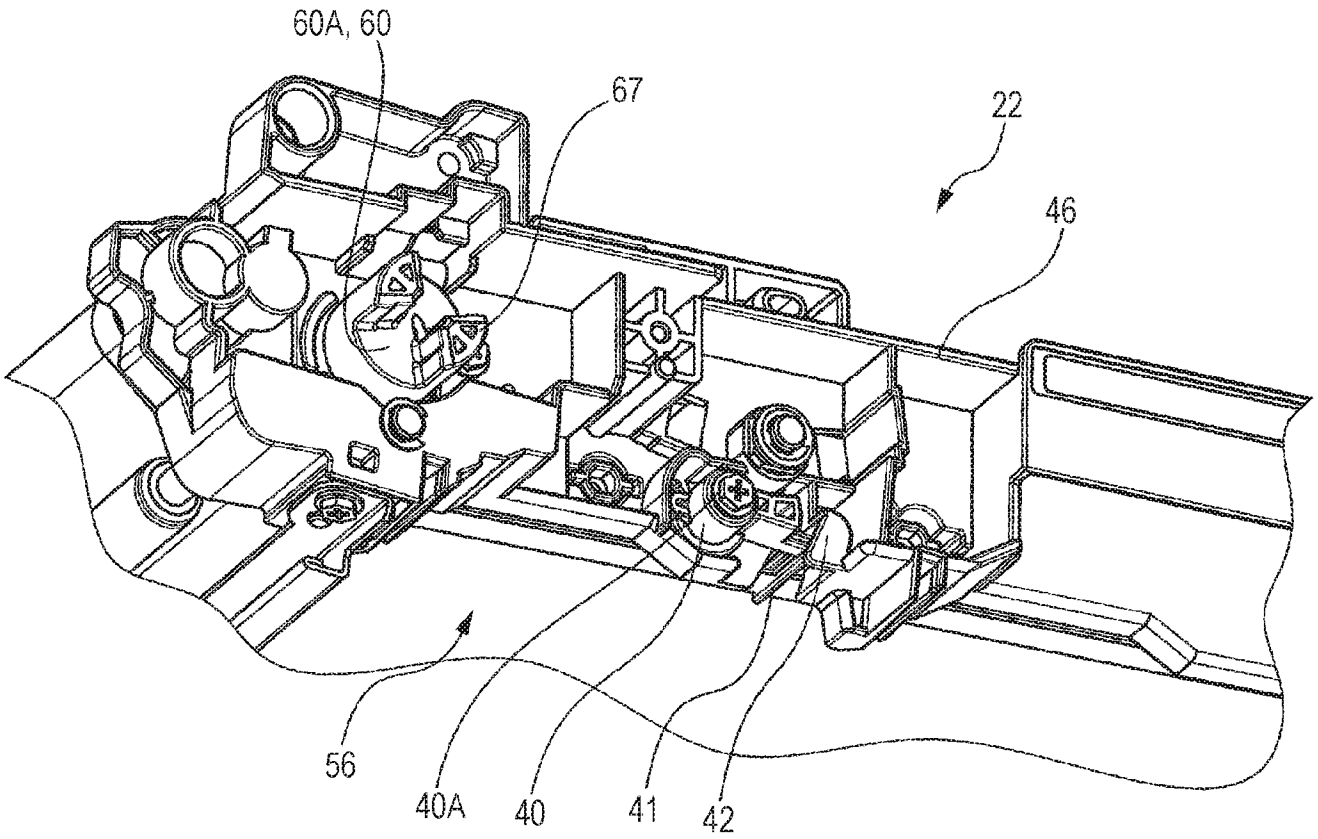
FIG. 7 illustrates the appearance of the holding mechanism when the edge of the transfer belt is held.

FIGS. 6 and 7 illustrate the appearance of the holding mechanism. FIG. 6 illustrates a state before the holding mechanism holds the edge of the transfer belt 56, and FIG. 7 illustrates a state of the holding mechanism when the holding mechanism holds the edge of the transfer belt 56.

A belt holding member 40 serving as part of the holding mechanism is attached to a side surface of the side frame 46 of the transfer unit 22 facing in the Z direction. The belt holding member 40 includes an arm portion 41. The arm portion 41 is separated from the transfer belt 56 while the transfer belt 56 is being in contact with the photoconductors 12. Rotation of the belt holding member 40 about a rotational shaft 40A in a direction in which the arm portion 41 approaches the transfer belt 56 is coupled with separation of the first transfer rollers 48 and the transfer belt 56 from the photoconductors 12. The details of this coupling of the rotation with the separation will be described later.

The belt holding member 40 corresponds to an example of a holding member. The arm portion 41 corresponds to an example of an arm of the holding member. The side frames 46 correspond to an example of frames.

The arm portion 41 projects from the outside of the edge portion of the transfer belt 56 toward the central portion of the transfer belt 56 and is brought into contact with the edge portion of the transfer belt 56 from the photoconductor 12 side when the belt holding member 40 is rotated. An outer circumferential surface of the transfer belt 56 facing the photoconductors 12 is a surface onto which the toner images are transferred from the photoconductors 12. However, part of the outer circumferential surface along the edge (edge portion) is a non-image region to which the toner images are not transferred. Out of the outer circumferential surface of the transfer belt 56, the central region, which is the outer circumferential surface excluding the non-image region (edge portion), is an image region to which the toner images are transferred.

When the arm portion 41 of the belt holding member 40 is brought into contact with the edge portion of the transfer belt 56, the edge of the transfer belt 56 is held by the belt holding member 40. Thus, loosening of the transfer belt 56 is suppressed. As a result, contact of the transfer belt 56 with the other components during the attachment and detachment of the transfer unit 22 may be avoided. Furthermore, the arm portion 41 is brought into contact with the non-image region of the transfer belt 56. This may eliminate the possibility of the image region of the transfer belt 56 to be damaged.

An overhang 42 is provided in the side frame 46. When the arm portion 41 approaches the transfer belt 56, the arm portion 41 enters the back side of the overhang 42 as illustrated in FIG. 7.

The transfer unit 22 includes a drive shaft 60 that drives the holding mechanism and the above-described separation mechanism. The holding mechanism and the separation mechanism are driven by applying a rotational drive force to the drive shaft 60.

The drive shaft 60 extends in the apparatus depth direction and is rotatably supported by the pair of side frames 46. An end portion 60A of the drive shaft 60 in the apparatus depth direction (+Z direction) penetrates through the side frame 46. Projections 67 are formed at the end portion 60A. The projections 67 project outward in the axial direction of the drive shaft 60 from the end portion 60A. When seen in the axial direction of the drive shaft 60, the projections 67 each have a sector shape, and a pair of the projections 67 are arranged point symmetrically to each other about the drive shaft 60.

According to the present exemplary embodiment, the rotational drive force applied to the drive shaft 60 is obtained by locking the collection box 34 to the housing 11 and unlocking the collection box 34 from the housing 11.

Figure 8:
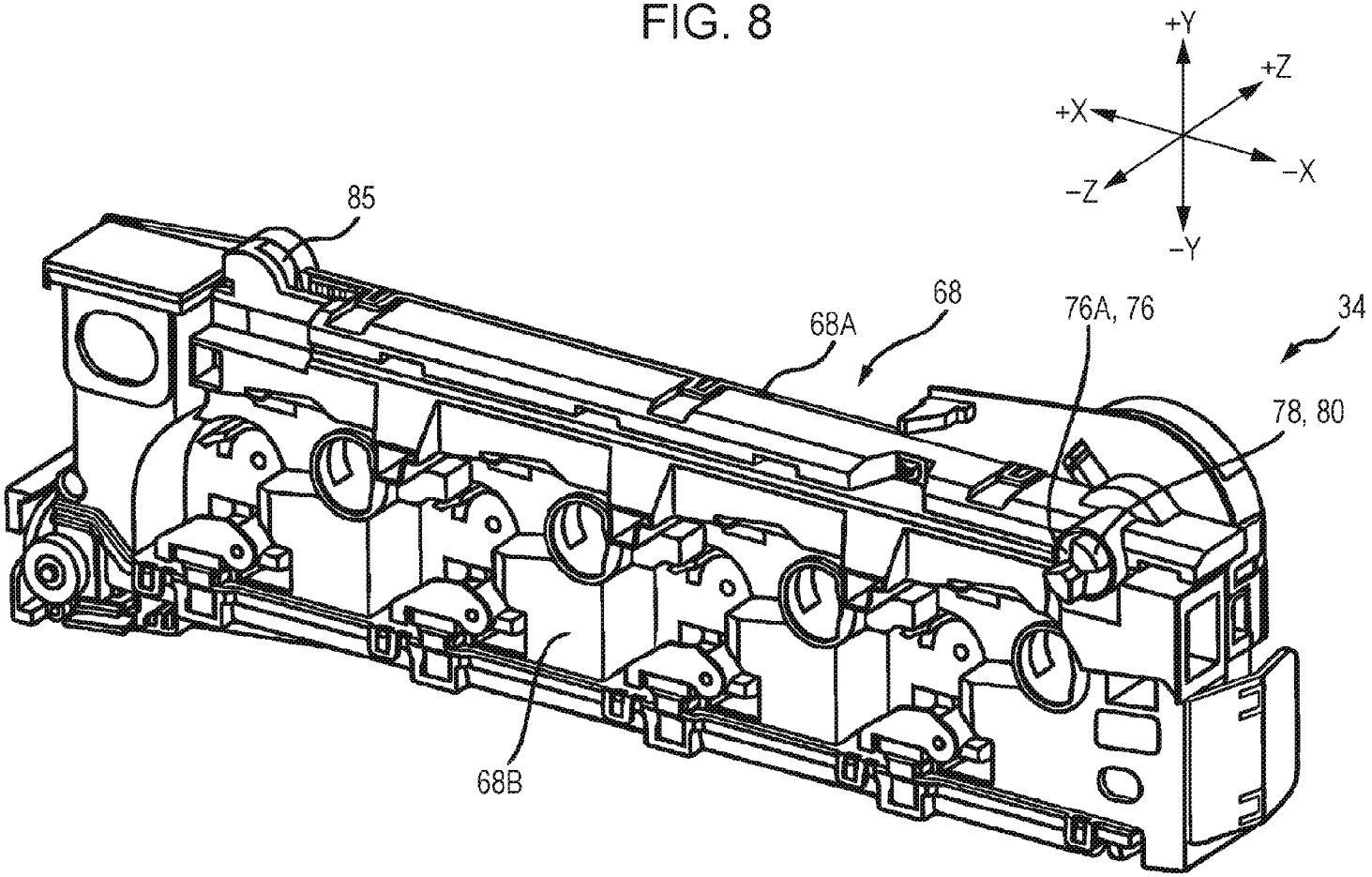
FIG. 8 illustrates a rear surface side of the collection box.
Figure 9:
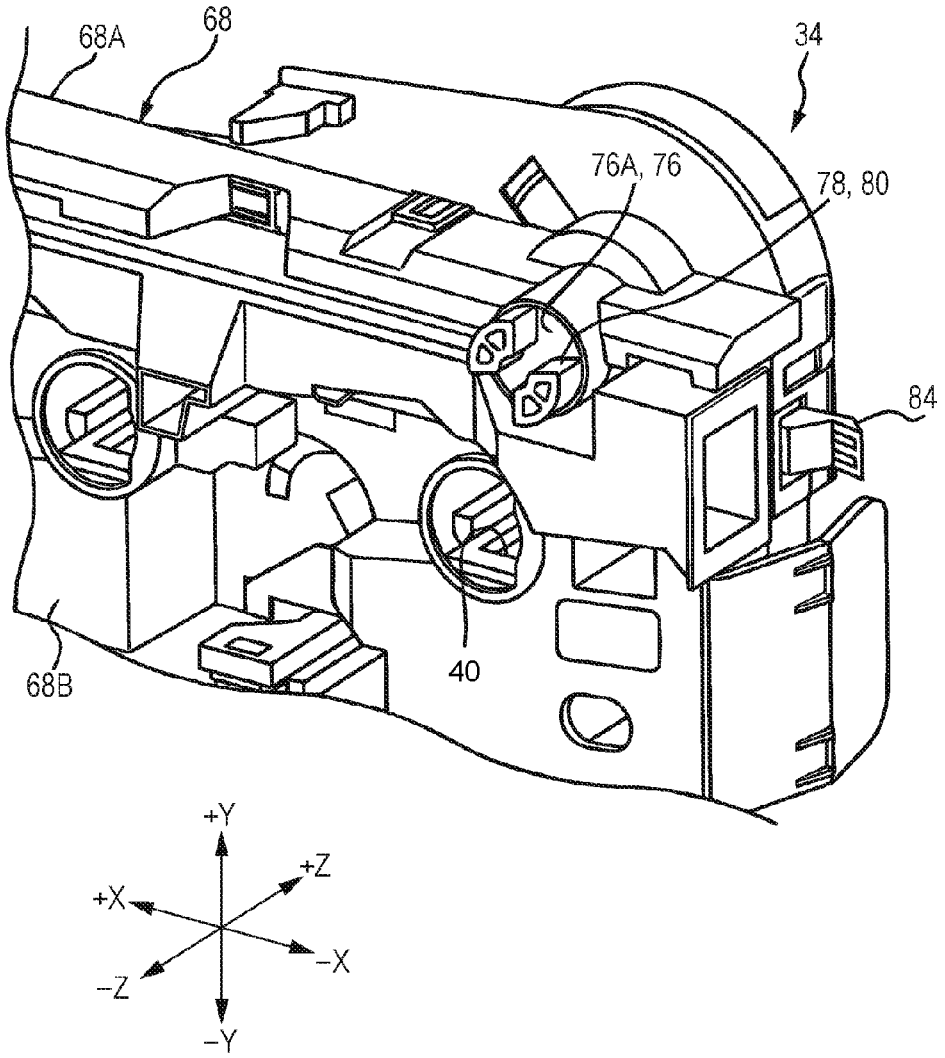
FIG. 9 is an enlarged view of part of the collection box.

FIG. 8 illustrates a rear surface side of the collection box 34. FIG. 9 is an enlarged view of part of the collection box 34.

A lock mechanism is incorporated in the body portion 68 of the collection box 34.

This lock mechanism includes a side hook portion 84 and an upper hook portion 85. The side hook portion 84 extends outward from an end portion of the body portion 68 in the apparatus width direction (−X direction). The upper hook portion 85 extends outward from an upper end portion of the body portion 68 in the apparatus up-down direction (+Y direction).

The side hook portion 84 and the upper hook portion 85 are moved in the apparatus width direction in conjunction with operation of the lock mechanism. The side hook portion 84 is hooked on a side hook receive portion (not illustrated) having a recessed shape formed on a side surface of an opening of the housing 11. The upper hook portion 85 is hooked on an upper hook receive portion (not illustrated) having a recessed shape formed on a top surface of the opening of the housing 11. The collection box 34 is locked (secured) to the housing 11 by respectively hooking the side hook portion 84 and the upper hook portion 85 on the side hook receive portion and the upper hook receive portion.

The collection box 34 includes a drive shaft 76 that drives the lock mechanism. The drive shaft 76 extends in the apparatus depth direction (Z direction) and is rotatably supported by the body portion 68. Ends of the drive shaft 76 respectively reach a front surface 68A and a rear surface 68B of the body portion 68. The operating handle 36 (see FIG. 3) is attached to an end portion of the drive shaft 76 on the front surface 68A side. A rotational drive force is applied to the drive shaft 76 by an operation performed by the user who holds this operating handle 36.

Projections 78 are provided at an end portion 76A of the drive shaft 76 on the rear surface 68B side. The projections 78 project in the axial direction of the drive shaft 76 from the end portion 76A. The projections 78 each have a sector shape when seen in the axial direction of the drive shaft 76. Also when seen in the axial direction of the drive shaft 76, a pair of the projections 78 are arranged point symmetrically to each other about the drive shaft 76.

The drive shaft 76 of the collection box 34 is connected to the drive shaft 60 of the above-described transfer unit 22 by a connecting structure 80 described below.

Figure 10:
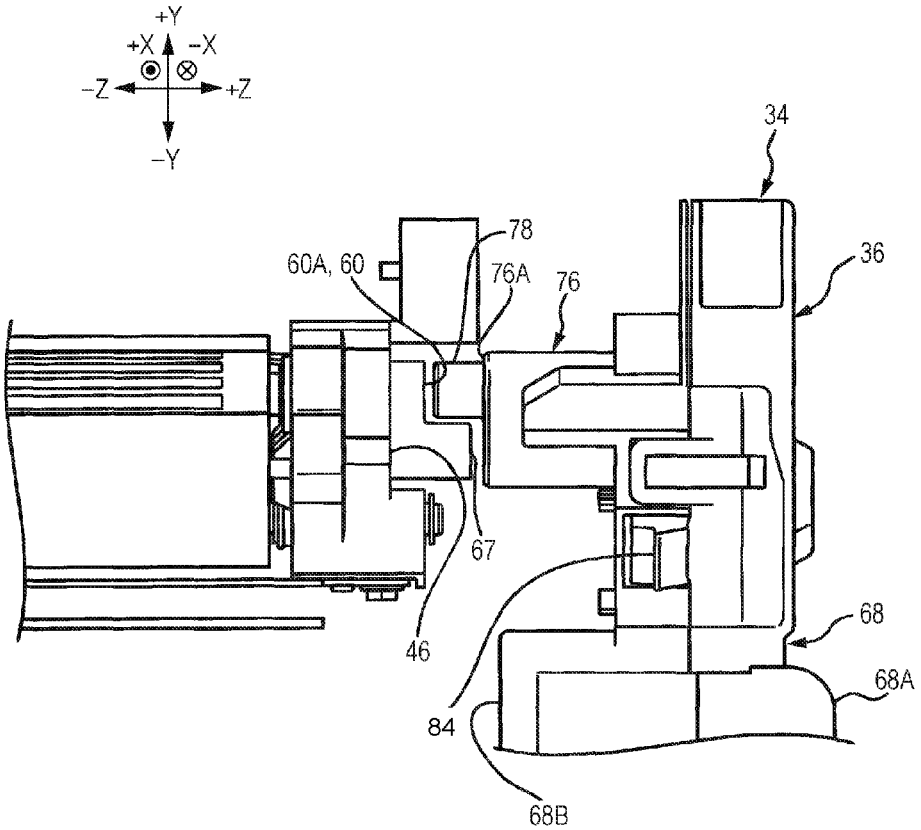
FIG. 10 illustrates a connecting structure.

FIG. 10 illustrates the connecting structure 80.

The connecting structure 80 connects the drive shaft 76 of the collection box 34 and the drive shaft 60 of the transfer unit 22 to each other when the collection box 34 has been attached to the housing 11. With such a connection, operations in which the collection box 34 is locked to and unlocked from the housing 11 are coupled with operations in which the first transfer rollers 48 and the transfer belt 56 approach and are separated from the photoconductors 12. Furthermore, as will be described later, these operations are also coupled with operations of the belt holding member 40 of the holding mechanism.

Specifically, the connecting structure 80 includes the projections 78 of the drive shaft 76 of the collection box 34 and the projections 67 of the drive shaft 60 of the transfer unit 22. When the projections 67 and the projections 78 are engaged with one another, the drive shaft 60 and the drive shaft 76 are connected to each other, thereby the rotational drive force is transmitted from the drive shaft 76 of the collection box 34 to the drive shaft 60 of the transfer unit 22. That is, when the operating handle 36 is rotated by the user, an operating force of the operating handle 36 rotates the drive shaft 76 of the collection box 34. The rotational drive force of the drive shaft 76 is transmitted to the drive shaft 60 of the transfer unit 22 via the connecting structure 80.

The separation mechanism and the holding mechanism are further described. The separation mechanism and the holding mechanism are operated in the transfer unit 22 by the rotational drive force transmitted as described above.

Figure 11:
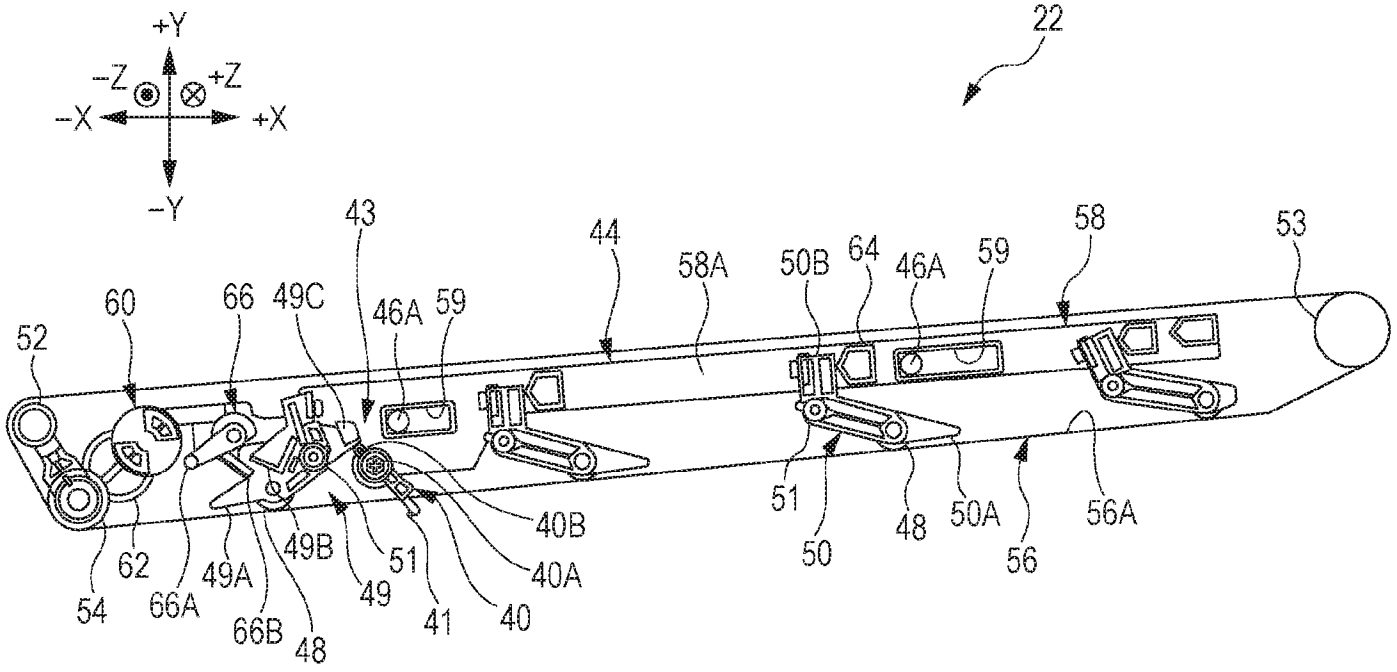
FIG. 11 illustrates internal structures of a separation mechanism and the holding mechanism in an approach state.
Figure 12:
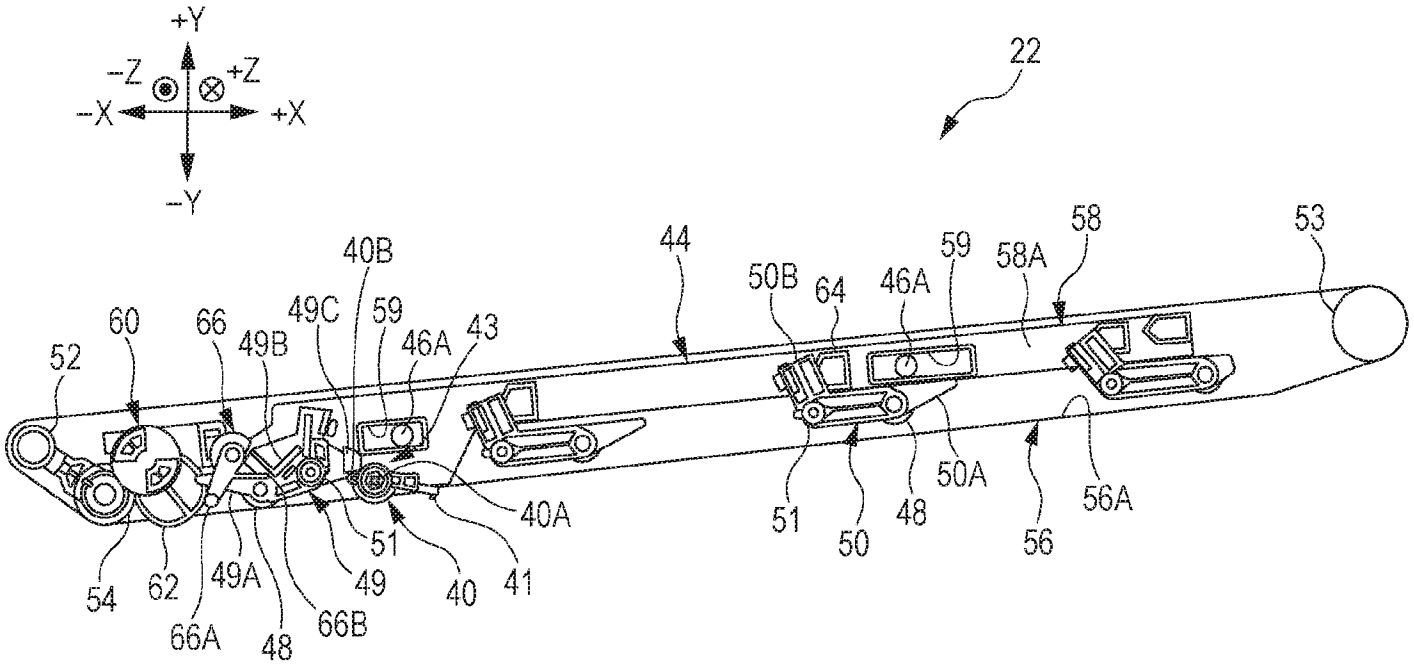
FIG. 12 illustrates internal structures of the separation mechanism and the holding mechanism in a separation state.

FIGS. 11 and 12 illustrate internal structures of the separation mechanism and the holding mechanism. FIG. 11 illustrates an approach state in which the first transfer rollers 48 and the transfer belt 56 approach the photoconductors 12. FIG. 12 illustrates a separation state in which the first transfer rollers 48 and the transfer belt 56 are separated from the photoconductors 12.

The transfer unit 22 includes, between the pair of side frames 46 (see FIG. 3), the first transfer rollers 48, the tension roller 52, the support roller 53, the backup roller 54, the transfer belt 56, a separation mechanism 44, and a holding mechanism 43.

Two or more (four according to the present exemplary embodiment) of the first transfer rollers 48 are attached to the side frame 46 through support arms 49 and 50. Furthermore, the first transfer rollers 48 are rotatably supported by the support arms 49 and 50 and disposed such that the axial directions thereof extend in the apparatus depth direction. Among a total of four support arms 49 and 50, a first support arm 49 closest to the drive shaft 60 causes the operations of the separation mechanism 44 to be coupled with the operations of the holding mechanism 43. The other support arms, that is, second support arms 50 operate as parts of the separation mechanism 44.

The support arms 49 and 50 are rotatably supported by respective rotational shafts 51 extending between the pair of side frames 46. The first transfer rollers 48 are each rotatably supported on one free end 49A side or one free end 50A side of the support arm 49 or the support arms 50. Furthermore, an elastic force caused by an elastic member (for example, a spring; not illustrated) constantly acts on each of the support arms 49 and 50. In the approach state, the support arms 49 and 50 press the first transfer rollers 48 against the inner surface 56A of the transfer belt 56 due to the elastic forces. Specifically, the first support arm 49 is pressed due to the elastic force of the elastic member in such a direction that the free end 49A rotates counterclockwise in, for example, FIG. 11 about the rotational shaft 51, and the second support arms 50 are each pressed in such a direction that the free end 50A rotates clockwise in, for example, FIG. 11 about the rotational shaft 51. Furthermore, projections 64 of a movable frame 58 are pressed against free ends 50B of the second support arms 50 on the opposite sides to the first transfer rollers 48. The movable frame 58 will be described later.

As described above, the separation mechanism 44 separates the first transfer rollers 48 from the photoconductors 12. The separation mechanism 44 includes the movable frame 58 and the drive shaft 60. A cam 62 is formed on the drive shaft 60.

The movable frame 58 is disposed further to the right side (+X direction) than the drive shaft 60 in the apparatus width direction. This movable frame 58 is attached to an inner wall of the side frame 46 and movable in the longitudinal direction (apparatus width direction) of the side frame 46. Specifically, plural slits 59 that extend in the apparatus width direction are formed in the movable frame 58. Pins 46A that project from the inner wall of the side frame 46 are inserted into the respective slits 59. Furthermore, the movable frame 58 according to the present exemplary embodiment is pressed rightward (+X direction) in the apparatus width direction by an elastic member (for example, a spring; not illustrated). As will be described later, when the state of the belt holding member 40 changes from the approach state to the separation state, the movable frame 58 is moved leftward (−X direction) in the apparatus width direction against an elastic force of the elastic member.

Furthermore, plural projections 64 are formed on an inner wall 58A of the movable frame 58. These projections 64 are pressed against the free ends 50B of the second support arms 50. When the movable frame 58 is moved leftward (−X direction) in the apparatus width direction, these projections 64 press the free ends 50B of the respective second support arms 50, thereby the second support arms 50 are rotated about the rotational shafts 51. As a result, the first transfer rollers 48 are moved upward and separated from the photoconductors 12. Furthermore, when the first transfer rollers 48 that have pressed the inner surface 56A of the transfer belt 56 are moved upward, the transfer belt 56 is also moved upward and separated from the photoconductors 12.

A transmission member 66 is provided between the drive shaft 60 and the movable frame 58 on the inner wall 58A of the side frame 46. The transmission member 66 transmits the drive force from the drive shaft 60 to the first support arm 49. The transmission member 66 is a rotational shaft that extends in the apparatus depth direction (Z direction). The transmission member 66 is supported by the side frame 46 so as to be rotatable in a certain angle range. The transmission member 66 includes a first extension 66A, a second extension 66B, and an engaging portion (not illustrated). The first extension 66A extends toward the cam 62 of the drive shaft 60. The second extension 66B branches off from the first extension 66A and extends toward the first support arm 49. The engaging portion engages with an engaged portion (not illustrated) of the movable frame 58 so as to move the movable frame 58 leftward in the apparatus width direction (−X direction).

The cam 62 is provided on the drive shaft 60 so as to outwardly extend in the radial direction of the drive shaft 60. When the drive shaft 60 is rotated by receiving the rotational drive force via the above-described connecting structure 80, the cam 62 is also rotated. When the collection box 34 is detached from the housing 11 while the belt holding member 40 is in the approach state of FIG. 11, the drive shaft 60 is rotated counterclockwise in, for example, FIG. 11 so as to change the state of the belt holding member 40 into the separation state of FIG. 12. When the cam 62 is rotated as described above, the cam 62 presses the first extension 66A of the transmission member 66 rightward in the apparatus width direction, thereby the transmission member 66 is rotated about the rotational shaft. As a result, the engaging portion of the transmission member 66 engages the engaged portion of the movable frame 58 so as to move the movable frame 58 leftward in the apparatus width direction, and the second extension 66B of the transmission member 66 presses an engaging portion 49B provided in the first support arm 49. When the engaging portion 49B of the first support arm 49 is pressed by the second extension 66B, the free end 49A side of the first support arm 49 is moved upward about the rotational shaft 51, thereby separating a corresponding one of the first transfer rollers 48 from the photoconductor 12.

Such operations of the separation mechanism 44 are coupled with the operations of the holding mechanism 43 as described below.

As part of the holding mechanism 43, the first support arm 49 includes a free end 49C located on the opposite side to the free end 49A that holds a corresponding one of the first transfer rollers 48. This free end 49C presses an engaging portion 40B of the belt holding member 40 when the engaging portion 49B of the first support arm 49 is pressed by the second extension 66B and rotated. As a result, the belt holding member 40 is rotated about the rotational shaft 40A, thereby the arm portion 41 of the belt holding member 40 is moved upward and holds the edge portion of the transfer belt 56.

When the state of the belt holding member 40 is changed from the separation state into the approach state, the first support arm 49 is rotated counterclockwise in, for example, FIG. 12 by the elastic force of the elastic member. As a result, the free end 49C having pressed the engaging portion 40B of the belt holding member 40 is moved upward. The belt holding member 40 is rotated clockwise in, for example, FIG. 12 due to the self-weight of the arm portion 41 extending from the rotational shaft 40A. Thus, the arm portion 41 is separated from the transfer belt 56.

Thus, the operations of the holding mechanism 43 are coupled with the operations of the separation mechanism 44 through the first support arm 49. A combination of the free end 49C of the first support arm 49 and the engaging portion 40B of the belt holding member 40 corresponds to an example of a coupling device.

The operations of the holding mechanism 43 are coupled with the operations of the separation mechanism 44. Thus, the belt holding member 40 may reliably hold the transfer belt 56 in the separation state. Accordingly, loosening of the transfer belt 56 during the attachment and detachment of the transfer unit 22 may be reliably suppressed, thereby, contact of the transfer belt 56 with the other components may be avoided.

At last, an attachment structure of the belt holding member 40 to the side frame 46 is described.

Figure 13:
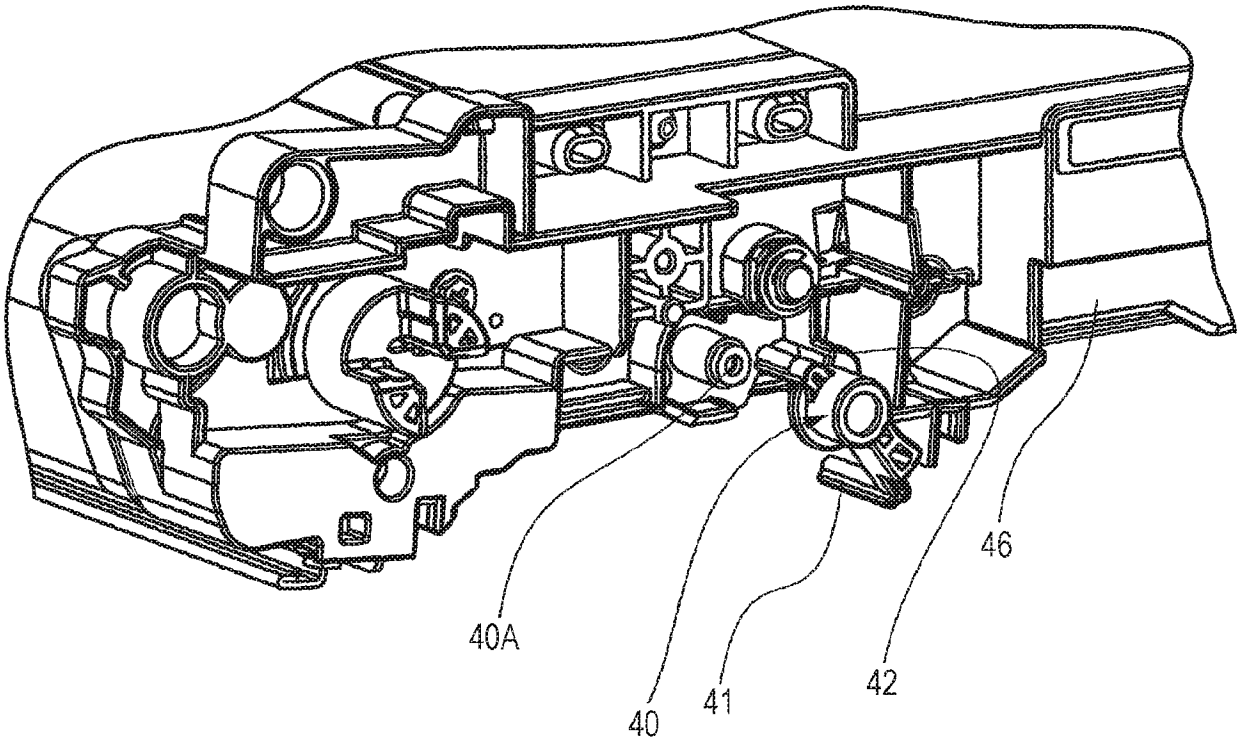
FIG. 13 illustrates a state in which a belt holding member is attached to a side frame.

FIG. 13 illustrates a state in which the belt holding member 40 is attached to the side frame 46.

The belt holding member 40 is attached to the side frame 46 from the outside of the transfer belt 56 in the width direction. Specifically, the belt holding member 40 is attached so as to cover the rotational shaft 40A that projects from the side frame 46. Since the belt holding member 40 is attached to the side frame 46 from the outside, the belt holding member 40 is easily attached to the side frame 46. When the arm portion 41 enters the inner circumferential side of the transfer belt 56 during the attachment of the belt holding member 40, the holding mechanism 43 does not function. Thus, the overhang 42 (also see FIGS. 6 and 7) is provided at such a position that the overhang 42 interferes with the arm portion 41 when the arm portion 41 is moved toward the inner circumferential side of the transfer belt 56. The belt holding member 40 is attached while being kept away from the overhang 42, thereby the arm portion 41 of the belt holding member 40 is reliably positioned on the outer circumferential side of the transfer belt 56. The overhang 42 corresponds to an example of a blocking portion.

Although a color printer exemplifies the one exemplary embodiment of the image forming apparatus in the above description, the image forming apparatus according to the exemplary embodiment of the present invention may be any of a monochrome image forming apparatus, a copier, a facsimile machine, and a multi-function machine.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer unit comprising:

a belt-shaped transfer target member that has an edge, an image region to which an image is transferred, and a non-image region to which the image is not transferred and which exists along the edge of the transfer target member and that is configured to be transported in a path passing through a contact position at which the transfer target member is brought into contact with an image holding body, which has a surface on which the image is held, so as to allow the image to be transferred to the transfer target member;

a first transfer device configured to transfer the image from the image holding body to the transfer target member; and a holding member that is configured to be brought into contact with the non-image region from an image holding body side so as to hold the transfer target member while contact of the holding member with the image region is avoided.

2. The transfer unit according to claim 1, wherein the transfer unit is detachably attached to a body including the image holding body, and wherein the holding member is configured to be separated from the transfer target member when the transfer target member exists on the path, and, during attachment and detachment of the transfer unit to and from the body, the holding member is configured to be brought into contact with the non-image region of the transfer target member in the case where the transfer target member deviates from the path.

3. The transfer unit according to claim 2, further comprising:

a coupling device configured to change, in conjunction with the deviation of the transfer target member from the path, a state of the holding member from a first state in which the holding member is separated from the transfer target member into a second state in which the holding member is in contact with the non-image region of the transfer target member.

4. The transfer unit according to claim 3, wherein the holding member is configured to be returned from the second state to the first state due to a weight of the holding member.

5. The transfer unit according to claim 4, further comprising:

a stretching member around which the transfer target member is stretched; and frames positioned on respective sides of the transfer target member with the transfer target member interposed therebetween so as to hold the stretching member, wherein one of the frames has an outer side, wherein the holding member is attached to the outer side of the one of the frames and includes an arm which extends toward the transfer target member, and the holding member holds the transfer target member with the arm.

6. The transfer unit according to claim 5, wherein the transfer target member has a front side that faces the image holding body and a rear side opposite to the front side, and wherein the one of the frames includes a blocking portion configured to interfere with the arm so as to block the attachment of the holding member when the arm is moved toward the rear side during the attachment of the holding member.

7. The transfer unit according to claim 3, further comprising:

a stretching member around which the transfer target member is stretched; and frames positioned on respective sides of the transfer target member with the transfer target member interposed therebetween so as to hold the stretching member, wherein one of the frames has an outer side, wherein the holding member is attached to the outer side of the one of the frames and includes an arm which extends toward the transfer target member, and the holding member holds the transfer target member with the arm.

8. The transfer unit according to claim 7, wherein the transfer target member has a front side that faces the image holding body and a rear side opposite to the front side, and wherein the one of the frames includes a blocking portion configured to interfere with the arm so as to block the attachment of the holding member when the arm is moved toward the rear side during the attachment of the holding member.

9. The transfer unit according to claim 2, further comprising:

a stretching member around which the transfer target member is stretched; and frames positioned on respective sides of the transfer target member with the transfer target member interposed therebetween so as to hold the stretching member, wherein one of the frames has an outer side, wherein the holding member is attached to the outer side of the one of the frames and includes an arm which extends toward the transfer target member, and the holding member holds the transfer target member with the arm.

10. The transfer unit according to claim 9, wherein the transfer target member has a front side that faces the image holding body and a rear side opposite to the front side, and wherein the one of the frames includes a blocking portion configured to interfere with the arm so as to block the attachment of the holding member when the arm is moved toward the rear side during the attachment of the holding member.

11. The transfer unit according to claim 1, further comprising:

a stretching member around which the transfer target member is stretched; and frames positioned on respective sides of the transfer target member with the transfer target member interposed therebetween so as to hold the stretching member, wherein one of the frames has an outer side, wherein the holding member is attached to the outer side of the one of the frames and includes an arm which extends toward the transfer target member, and the holding member holds the transfer target member with the arm.

12. The transfer unit according to claim 11, wherein the transfer target member has a front side that faces the image holding body and a rear side opposite to the front side, and wherein the one of the frames includes a blocking portion configured to interfere with the arm so as to block the attachment of the holding member when the arm is moved toward the rear side during the attachment of the holding member.

13. An image forming apparatus comprising:

an image holding body that has a surface configured to hold an image;

an image forming device configured to form the image on the surface of the image holding body;

a belt-shaped transfer target member that has an edge, an image region to which the image is transferred, and a non-image region to which the image is not transferred and which exists along the edge of the transfer target member and that is configured to be transported in a path passing through a contact position at which the transfer target member is brought into contact with the image holding body so as to allow the image to be transferred thereto;

a first transfer device configured to transfer the image from the image holding body to the transfer target member;

a holding member that is configured to be brought into contact with the non-image region from an image holding body side so as to hold the transfer target member while contact of the holding member with the image region is avoided; and a second transfer device configured to transfer the image from the transfer target member to a recording medium.

* * * * *